US005492515A

United States Patent [19]

Charnitski

[11] Patent Number: 5,492,515

[45] Date of Patent: Feb. 20, 1996

[54] CLIMBING EXERCISE MACHINE

[76] Inventor: Richard D. Charnitski, 25601 Adriana St., Mission Viejo, Calif. 92691

[21] Appl. No.: 396,550

[22] Filed: Mar. 1, 1995

[51] Int. Cl.[6] ..... A63B 22/12; A63B 1/00

[52] U.S. Cl. ..... 482/51; 482/37

[58] Field of Search ..... 482/51, 70, 52, 482/53, 37, 62, 72; 601/33, 34, 35; 434/255

[56] References Cited

U.S. PATENT DOCUMENTS

| | | | |
|---|---|---|---|
| 2,079,594 | 5/1937 | Clem . | |
| 3,213,852 | 10/1965 | Zent | 482/62 |
| 3,363,335 | 1/1968 | Burhns et al. . | |
| 3,381,958 | 5/1968 | Gulland . | |
| 3,582,069 | 6/1971 | Flick et al. . | |
| 4,830,362 | 5/1989 | Bull . | |
| 4,900,013 | 2/1990 | Rodgers | 482/72 |
| 4,934,690 | 6/1990 | Bull . | |
| 4,958,830 | 9/1990 | Huggins et al. . | |
| 5,000,441 | 3/1991 | Wang | 482/51 |
| 5,040,785 | 8/1991 | Charnitski . | |
| 5,054,770 | 10/1991 | Bull . | |
| 5,224,909 | 7/1993 | Hamilton | 482/51 |
| 5,256,117 | 10/1993 | Potts et al. . | |
| 5,342,262 | 8/1994 | Hansen . | |

FOREIGN PATENT DOCUMENTS

WO9206746 4/1992 WIPO .

OTHER PUBLICATIONS

Sales Brochure by Applicant regarding Versa–Climber dated Mar. 15, 1989.

*Primary Examiner*—Stephen R. Crow

*Attorney, Agent, or Firm*—Knobbe, Martens, Olson & Bear

[57] ABSTRACT

An exercise machine for simultaneous upper body exercise and lower body exercise is provided. The exercise machine has handles and pedals for climbing that move in synchronized motions in generally the same plane to simulate a vertical climbing action. The handles and pedals are interconnected such that the user of the exercise machine moves in a coordinated, synchronized climbing motion. The range of the arm movement is different than the range of the leg movement such that the exercise or work of the upper body may be different or adjustable relative to the exercise or work of the lower body.

23 Claims, 7 Drawing Sheets

CLIMBING EXERCISE MACHINE

BACKGROUND OF THE INVENTION

1. Field of the Invention

The present invention relates in general to an exercise device and, in particular, to an improved climbing exercise machine.

2. Description of Relevant Art

Many persons in different levels of physical condition and types of athletic ability desire to improve their overall physical fitness and cardiovascular capability. Prior exercise devices provide a wide range of motions and activities for increasing physical fitness. For example, known exercise devices may strengthen and condition individual muscles or various muscle groups of the user. Prior exercise devices may also exercise the entire body simultaneously to increase the overall physical fitness of the user.

Prior exercise devices frequently simulate different motions such as walking, running and climbing. Climbing is particularly advantageous because it exercises the upper and lower body simultaneously, and it efficiently and effectively exercises all the major muscle groups of the body. Prior climbing devices emulate a climbing motion by having moveable handles and foot pedals which move in a generally predetermined pattern or range of motion. Such known devices typically include a generally vertically extending frame having two elongated reciprocating support members that are interconnected. The interconnection causes the support members to move in opposite directions such that when one support member moves downwardly, the other support member moves upwardly. Attached to each support member is a handle and foot pedal which extend outwardly from the frame member. The handles and foot pedal allows the user to control the movement of the exercise device and simulate the desired climbing motion.

In operation of prior climbing exercise devices, a user grasps the handles and places his or her feet onto the pedals. The user then exercises by pushing down on one pedal with one leg and pulling down with his or her arm on the handle on the same side of the device. This force causes the support member on that side of the exercise device to move downwardly. Because the handle and foot pedal are securely fixed to the elongated support member, the arm and leg of the user move in unison and they are always separated by a constant distance. The arm and leg of the user on the other side of the body moves upwardly because the support members are interconnected such that they move in opposite directions. Thus, while the arm and leg of the user is moving downwardly on one said of the body, the arm and leg on the other side of the body is moving upwardly. When one leg of the user is extended in an almost straight position, the user then pushes down on the opposite pedal and pulls down on the other handle to cause the other support member to begin traveling in a downward direction. This implements a basic climbing motion of the user.

The leg and arm on one side of the body is always moving at the same speed as the leg and arm on the other side of the body, but in opposite directions, because the support members are interconnected by an inelastic flexible member such as a chain. Additionally, the distance traveled by each arm and leg is exactly the same because they are interconnected by the elongated support members. This approach to vertical climbing is commonly referred to as a "homolateral pattern" because the arm and leg on one side of the body are moving in the same direction, and the arm and leg on the opposite side of the body are moving in the opposite direction.

Prior exercise devices include U.S. Pat. No. 5,040,785 issued to Charnitski, the same inventor of the present invention. The Charnitski patent discloses a climbing exercise device wherein the foot pedals and handles move in the same plane. In particular, a right handle and a right foot pedal extend from the right side of an elongated, vertically extending frame. A left handle and a left foot pedal extend from the left side of the frame. The handles and foot pedals are attached to four separate sliding trucks which are movably guided by rollers that move within two parallel tracks located in the frame. The handles are attached to the two upper trucks and the foot pedals are attached to the two lower trucks. The four trucks are interconnected by a chain and the trucks are arranged for side-by-side reciprocating movement in a direction parallel to one another. The handle and foot pedal on each side of the frame moves simultaneously because they are connected by the chain. The handle and foot pedal on one side of the frame also moves simultaneously with the handle and foot pedal on the other side of the frame, but in an opposite direction because the trucks are interconnected by the chain. Thus, the right handle and foot pedal moves in synchronized, unison movement with the left handle and foot pedal.

The Charnitski patent also discloses the chain interconnecting the upper and lower trucks may be crossed through a center opening such that the left handle truck and the right foot pedal truck, and the right handle truck and the left foot pedal truck, are directly connected by the chain. This creates a "cross crawl pattern" climbing exercise wherein the right arm and right leg extend away from one another as the left arm and left leg move towards one another, and vice versa. In this embodiment, the handles and foot pedals stay in the same plane during the entire range of motion, and the speed and distance traveled by each arm and leg of the user is exactly the same because the handles and foot pedals are securely interconnected by the chain.

Prior climbing devices move the arms and legs of the user the same distance in both the homolateral and cross crawl patterns because the handles and foot pedals are directly connected by a chain. Thus, for example, if the handle moves within a range of motion of 20 inches from its uppermost position to its lowermost position, the range of motion for the foot pedal is also 20 inches. This range of motion is the same for both arms and legs of the user because of the interconnecting chain.

SUMMARY OF THE INVENTION

The prior exercise devices which provide for movement of the arms and legs within a synchronized range of motion of approximately 20 inches rapidly exhaust many people because the step height of 20 inches is much larger than the typical 8 to 10 inch step height of a person. Thus, many people must exert a large amount of energy to move their legs within a range of motion of 20 inches. Additionally, the range of motion of a person's arms is naturally larger than the range of motion of their legs, and many persons desire to move their arms at a rapid rate such that they perceive a thorough upper body workout.

The applicant determined that because the speed and movement of the arms and legs of the user are the same in prior climbing machines, many persons using these machines become quickly exhausted since they move their legs through a large range of motion and at a rapid rate to keep pace with the movement of their arms. In fact, many persons moving their legs through a 20 inch range of motion and at a high climbing rate become exhausted in less than two minutes. As a result, many persons perceive these prior climbing machines as being only for the highly athletic and physically fit.

The present invention is an improved apparatus and method for a full body climbing exercise machine which overcomes these disadvantages of the prior full body climbing machines. The new exercise machine includes pedals for lower body exercise and moveable handles for simultaneous and synchronized upper body exercise.

In accordance with one aspect of the invention, a climbing exercise machine includes pedals which move within a range of motion and handles which move within another range of motion. The range of motion of the arm movement is preferably about four times the range of motion of the leg movement.

In accordance with another aspect of the invention, the handles and pedals move in synchronized, coordinated movements. The range of motion of the handles is different than the range of motion of the pedals such that the upper body and the lower body are exercised a different amount.

Another aspect of the present invention includes a control panel which may display information such as the rate of movement, the calories expended or the work done by the user. The control panel is releasably connected to the invention such that the user may place the control panel at eye level.

In accordance with an additional aspect of the invention, the ratio between the movement of the arms may be adjusted relative to the movement of the legs. This allows the user to adjust the amount of upper body exercise to the amount of lower body exercise.

BRIEF DESCRIPTION OF THE DRAWINGS

These and other features of the invention will now be described with reference to the drawings of preferred embodiments, which are intended to illustrate and not to limit the invention, in which.

DETAILED DESCRIPTION OF THE PREFERRED EMBODIMENTS

Figure 2:
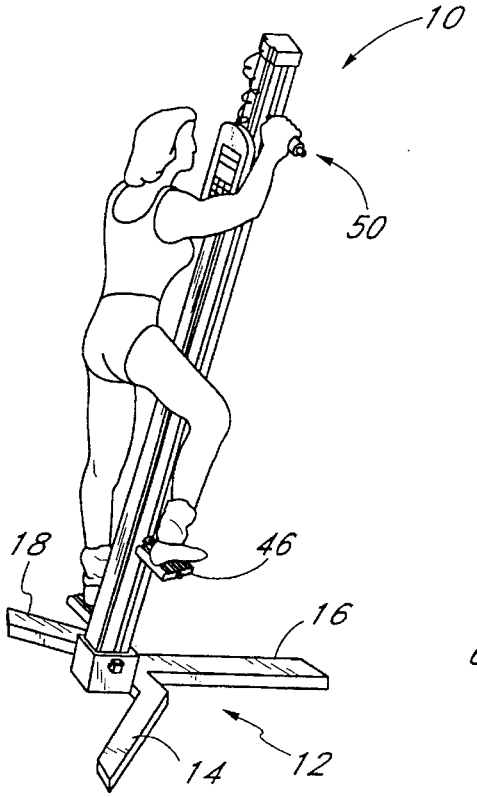
FIG. 2 is a perspective side view of the climbing exercise machine of FIG. 1.
Figure 1:
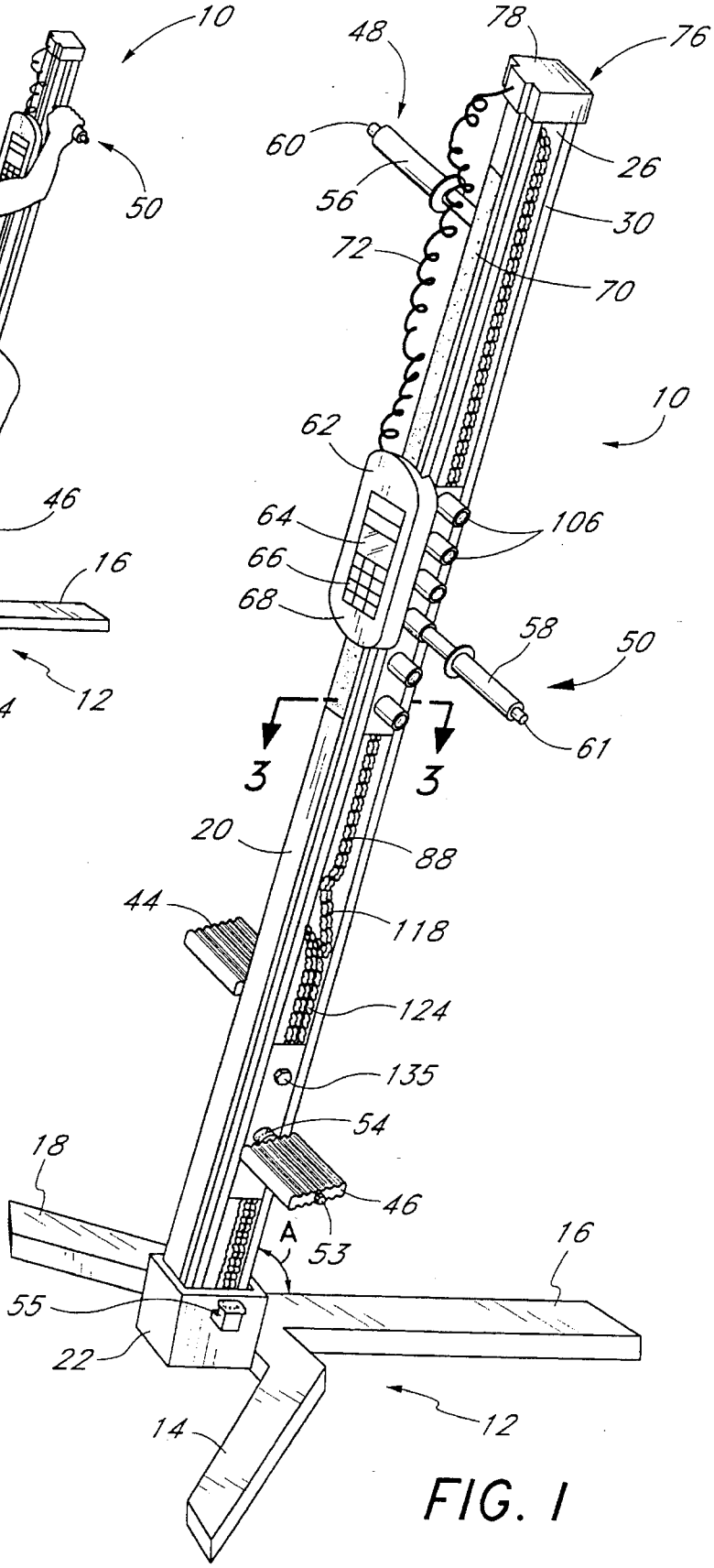
FIG. 1 is a perspective side view of a climbing exercise machine in accordance with the preferred embodiment of the present invention.

As seen in FIGS. 1 and 2, the climbing exercise machine 10 is configured in accordance with a preferred embodiment of the present invention. The climbing exercise machine 10 includes a base 12 that supports the exercise machine 10 on a generally flat surface such as a floor. The base 12 includes three outwardly extending arms 14, 16 and 18 which are located in generally the same plane to provide an essentially flat surface for support of the exercise machine 10. The arms 14, 16 and 18 are preferably constructed from a material such as rectangular steel channels or other suitably rigid material. The arms 14, 16 and 18 of the base 12 should be of sufficient length and strength to support the user and the exercise machine 10. Downwardly extending projections or foot pads (not shown), but well known in the art, may be attached proximate each end of the extending arms 14, 16 and 18 to support the exercise machine 10 like a tripod, said projections may be adjustable to permit leveling of the base 12 on an uneven surface. Further, the arms 14, 16 and 18 are preferably securely connected by means such as bolts (not shown) to create a stable base 12 for the exercise machine 10. Alternatively, the base 12, formed of arms 14, 16 and 18, may be welded together or formed of a single piece of material such as steel.

Generally vertically extending from the base 12, and proximate the interconnection of the arms 14, 16 and 18, is an upright frame 20. The upright frame 20 is securely held relative to the base 12 by a bracket 22 and the upright frame 20 is generally inclined at an angle A, measured from the horizontal, as illustrated in FIG. 1 to facilitate the climbing motion of the user. The angle A is preferably between 0 and 90 degrees, and more preferably between 65 and 85 degrees, and most preferably 75 degrees. The upright frame 20 is preferably connected of a metallic material such as steel to provide sufficient support for the user.

Figure 3:
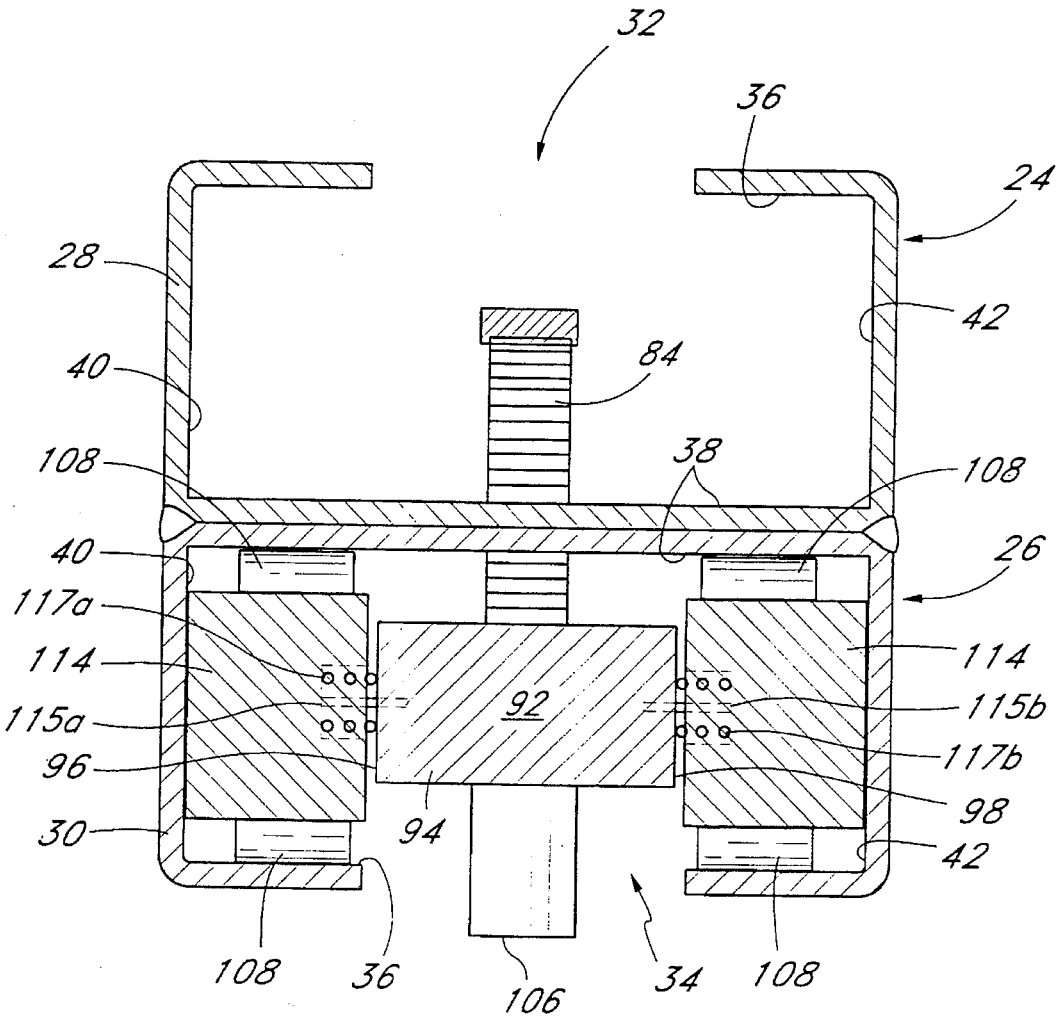
FIG. 3 is a cross sectional view along line 3—3 of FIG. 1.

The upright frame 20 includes two longitudinally extending tracks 24 and 26 located on each side of the upright frame 20. As seen in FIGS. 1 and 3, the tracks 24 and 26 are preferably created by joining two generally rectangular "C" channels 28 and 30 such that longitudinally extending openings or slots 32 and 34 are formed on opposing sides of the upright frame 20. Alternatively, the tracks 24 and 26 may be integrally formed or constructed from a wide variety of materials, such as extruded aluminum or plastic. As shown in detail in FIG. 3, the two "C" channels 28 and 30 are preferably hollow rectangular steel tubes having a front wall 36, a back wall 38, and opposed side walls 40 and 42. The "C" channels 28 and 30 are adjacently aligned and the back walls 38 are connected by means such as welding.

It will be recognized that the upright frame 20, back walls 38, and the arms 14, 16 and 18 may be joined by a variety of means including as integral formation, brazing, soldering, bolting, screwing, adhesives and the like. Additionally, other known materials could also be used for forming the upright frame 20, base 12 and "C" channels 28 and 30, including other types of metal such as aluminum, or nonmetal materials such as fiberglass, resins, plastics, ceramics and wood.

Extending through the slots 32 and 34 are left and right pedals 44 and 46, and left and right handles 48 and 50, respectively, as seen in FIG. 1. The pedals 44 and 46 are located proximate the base 12 of the exercise machine 10. Although not shown, the pedals 44 and 46 may also contain a stirrup or strap to keep the user's foot in contact with the pedal during exercise. The pedals 44 and 46 are preferably constructed of a material such as plastic, and the pedals 44 and 46 preferably include a friction surface to avoid slipping of the user.

Figure 8:
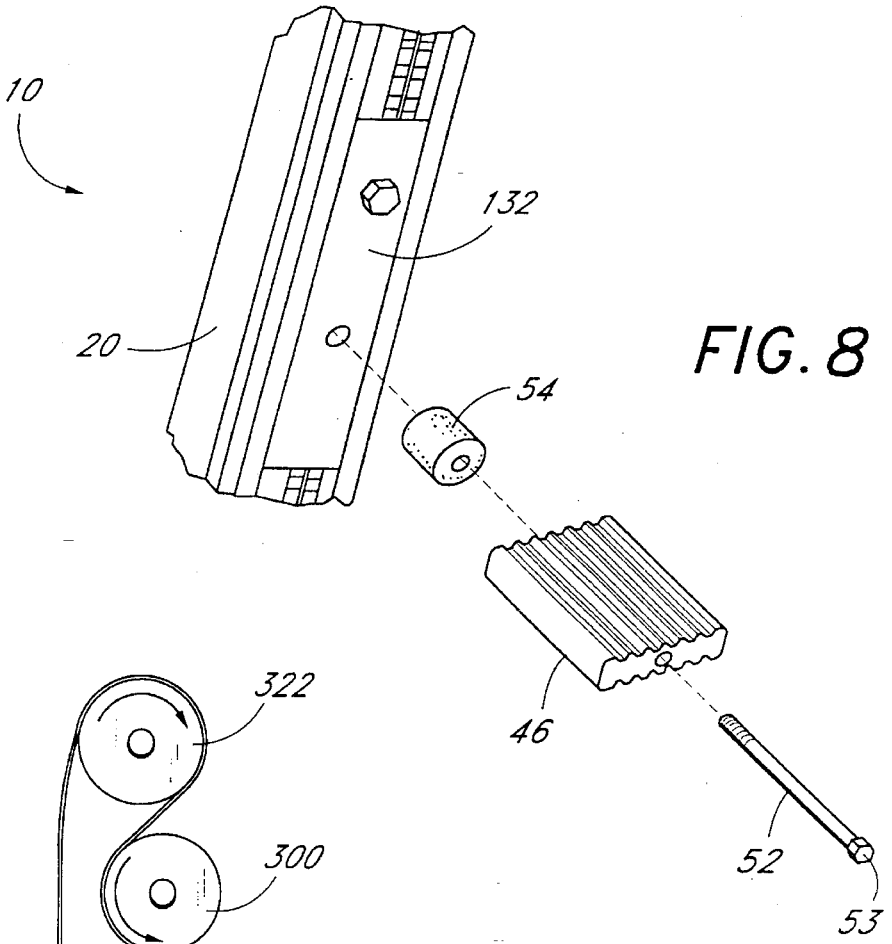
FIG. 8 is an exploded view showing the connection of a foot pedal to a foot truck.

As best seen in FIG. 8, a pedal arm 52 is used to connect the pedal 46 to the exercise machine 10. The pedal arm 52 may be an elongated bolt or rod with and head 53 on one end, and the other end extends through an aperture in the pedal 46 and a rubber sleeve 54. As described below, the pedal arm 52 is preferably threadably connected to the exercise machine 10 such that the pedal 46 can support the user. Alternatively, the pedal may be bolted to the exercise machine 10. The pedal arm 52 is preferably constructed of a metallic material such as steel or cast iron. As best seen in FIG. 1, the rubber sleeve 54 may contact a rubber bumper 55 located proximate the base 12 to limit the downward movement of the pedal 46.

The handles 48 and 50 include cylindrical, padded and elongated grips 56 and 58 located proximate the distal ends of the handles 48 and 50. The grips 56 and 58 provide for comfortable holding of the handles by the user. The handles 48 and 50 are preferably releasably attached to the exercise machine 10 by pressing a button 60 or 61 longitudinally extending from the distal end of the handle. As described below, the releasable connection of the handles 48 and 50 provide for ready adjustment and quick connection of the handles 48 and 50 to the exercise machine 10 at the desired locations. This allows users of different heights to readily adjust the handles 48 and 50 to the proper height.

As seen in FIGS. 1, a controller 62 is attached to the upright frame 20. The controller 62 preferably includes a display 64 and a plurality of keys 66. The keys 66 allow the user to input information to a processor 68 located within the controller 62. The processor 68 can provide a visual output to the user on the display 64. The controller 62 is preferably releasably connected to the upright frame 20 by means such as a hook and loop fastener 70, known by the trademark Velcro. The mating surface of the hook and loop fastener 70 is secured to the back side of the controller 62. Further, the controller 62 may be shaped to positively engage a front face of the upright frame 20. Advantageously, the adjustable connection allows the user to correctly position the controller 62 at about eye level such that the display 64 and the keys 66 may be easily seen and manipulated by the user, as illustrated in FIG. 2. The processor 68 preferably has a memory which stores information and permits the user to select a pre-programmed exercise program or to configure an individualized exercise program.

The controller 62 may be connected by a wire 72 or other communication means to a sensor (not shown) located proximate the upper end 76 of the exercise machine 10. The sensor may be covered by a cap 78 and the sensor preferably includes an encoded disk with an infrared reader to provide information to the processor 68. This information allows the processor 68 to calculate information such as the speed of climbing, range of motion, work done and calories expended by the user. This information may then be seen by the user on the display 64. Additionally, the processor 68 may contain an internal clock or timing mechanism which permits the controller 62 to display information such as the time spent exercising or the time remaining to exercise in a preselected exercise program.

Figure 4:
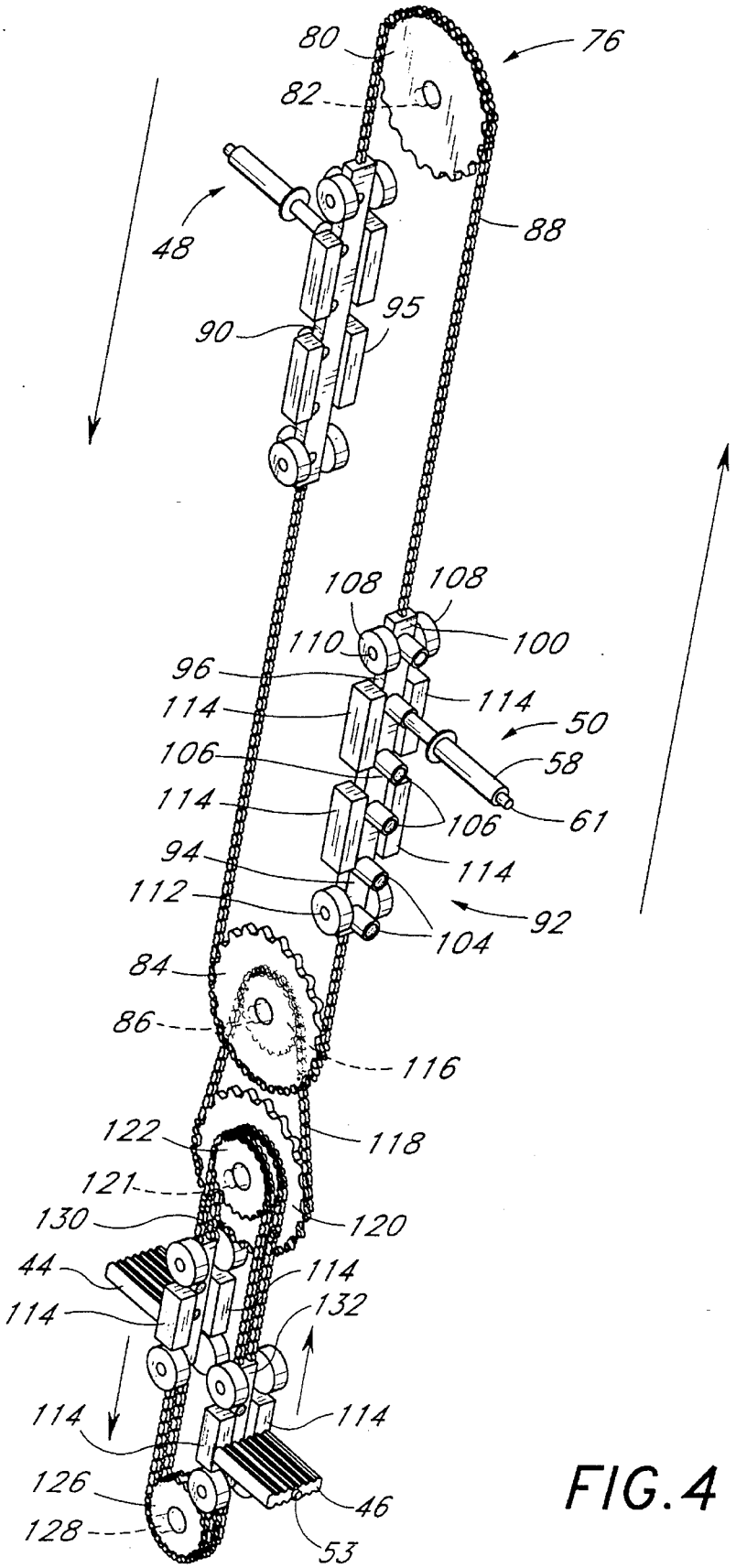
FIG. 4 is a perspective side view of the chains and trucks of the climbing exercise machine of FIG. 1 wherein a left handle and pedal are in an uppermost position and a right handle and pedal are in a lowermost position.
Figure 5:
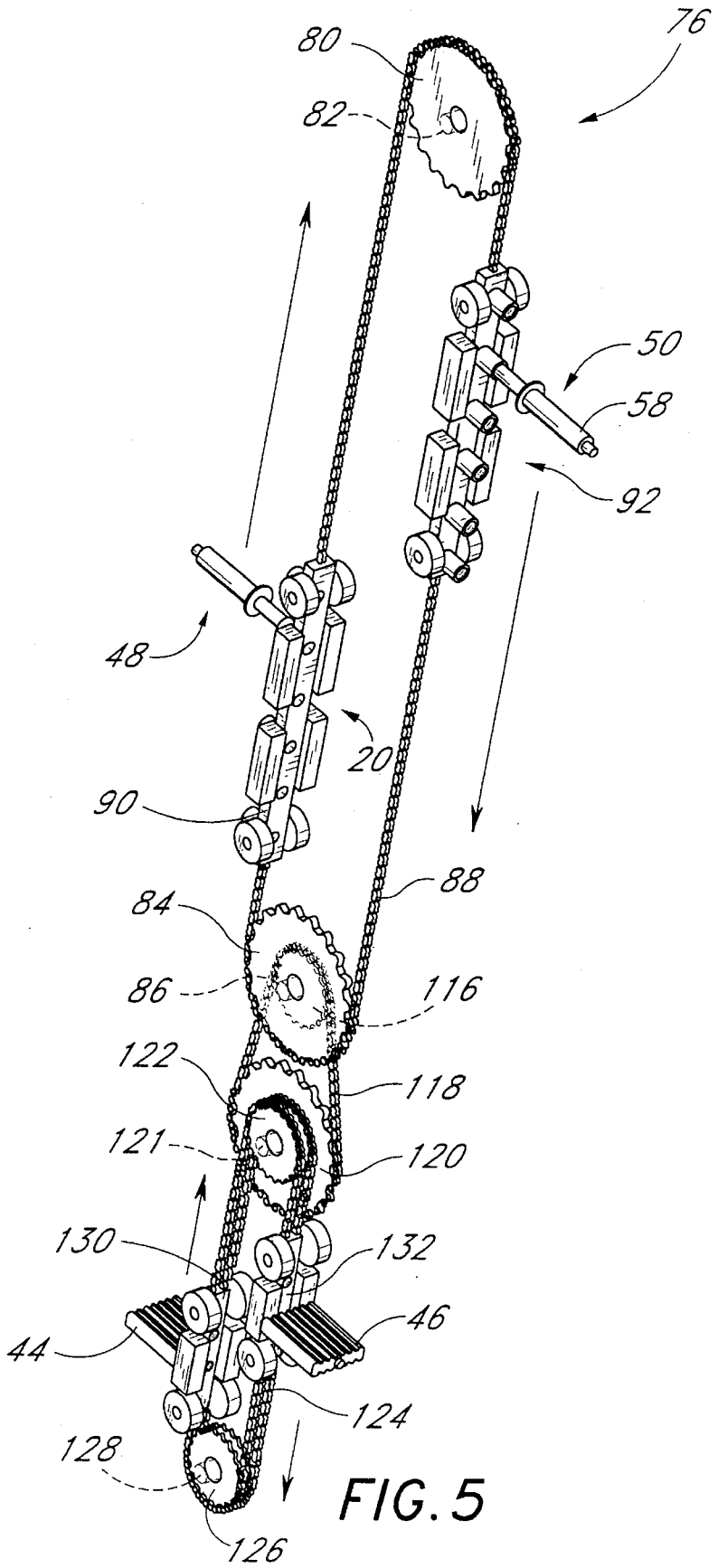
FIG. 5 is a perspective side view of the chains and trucks of the climbing exercise machine of FIG. 1 wherein a left handle and pedal are in a lowermost position and a right handle and pedal are in an uppermost position.

As best seen in FIGS. 4 and 5, located at the upper end 76 of the upright frame 20 is a sprocket 80 which is rotatably mounted on an axle 82, and located proximate a middle of the upright frame 20 is a sprocket 84 which is rotatably mounted on an axle 86. A chain 88 or other substantially inelastic connection engages the sprockets 80 and 84. The left and right handles 48 and 50 are attached to the chain 88 by left and right hand trucks 90 and 92, respectively. Because the hand trucks 90 and 92 are generally identical in function and formation, only the hand truck 92 will be described in detail. The hand truck 92 comprises an elongated rectangular body 94 which is preferably constructed from a rigid material such as steel. The hand truck 92 includes a left wall 96, a right wall 98, a front wall 100 and a rear wall 102. Extending from the front wall 100 are six vertically aligned protrusions 104 which are centered along the longitudinal axis and positioned at equally spaced locations along the length of the body 94. Apertures 106 are located at the distal end of the protrusions 104 from the body 94 of the truck 92, and the apertures 106 extend through the protrusions 104.

The hand trucks and movement of the hand trucks within the tracks is similar to that disclosed in U.S. Pat. No. 5,040,785 which issued Aug. 20, 1991, entitled "Climbing Exercise Machine", and invented by the same inventor. The disclosure of U.S. Pat. No. 5,040,785 is hereby incorporated by reference.

The apertures 106 are configured to receive the end of the handle 50 and create a secure connection between the handle 50 and the hand truck 92. The inner surface of the apertures 106 may have an annular ring which is configured to engage a detent or other protrusion which extends radially outwardly from the end of the handle 50 opposite the grip 58. Preferably, depressing the button 61 extending from the end of the handle 50 near the grip 58 releasably disconnects the handle 50 from the hand truck 92. Alternatively, the apertures 106 may have a threaded interior and the ends of the handles may have a mating threaded exterior wherein the interior is configured to receive and securely engage the handle 50. This connection between the handle 50 and the truck 92 desirably enables the handle 50 to withstand the pressure applied by the user during exercise. The six apertures 106 provides a wide range of adjustable hand positions for users of different heights because the user can vary the height between the handles 48 and 50, and the pedals 44 and 46, respectively. Preferably, the handles 48 and 50 are adjusted to be about the shoulder height of the user.

Proximate each end of the body 94 of the truck 92 is an adjacent pair of rollers 108. Each of the rollers 108 has a central aperture 110 which is horizontally aligned with a similar aperture (not shown) provided at both ends of the body 94 of the hand truck 92. An axle 112 rotatably attaches the rollers 108 to the body 94. As seen in FIG. 3, the rollers 108 act as wheels that roll within the track 26 of the upright frame 20. In particular, the rollers 108 are in contact with the front wall 36 and the back wall 38 of the "C" channel 30. When the truck 92 is positioned with the track 26, the aperture 106 is aligned with the slot 34 in the upright frame 20 such that a handle can extend outwardly from the upright frame 20.

Two generally identical sliding blocks 114 are disposed along each side of the body 94 of the truck 92. The sliding blocks 114 are preferably constructed from a wear-resistant material such as plastic. More preferably, the plastic is molydisulfide impregnated nylon which creates a low friction and wear resistant sliding block 114. The sliding blocks 114 are preferably rectangular in shape and the sliding blocks 114 engage the side walls 40 and 42, respectively, of the channel 30. As seen in FIG. 3, the sliding blocks 114 are preferably connected by pins 115*a* and 115*b* to the left wall 96 and right wall 98 of the body 94, respectively. Springs 117*a* and 117*b* are preferably disposed between the body 94 and the sliding blocks 114 to keep the sliding blocks 114 in contact with the side walls 40 and 42 of the channel 30. The springs 117*a* and 117*b* also allow a pretension or preload to be established which must be overcome before the truck moves within the channel 30.

In operation, the hand truck 92 moves within the track 26 of the upright frame 20. The rollers 108 are rotatably disposed between the front wall 36 and back wall 38 to permit the truck 26 to move with the channel 30. The sliding blocks 114 engage the side walls 40 and 42 to prevent the body 94 from coming into contact with the walls of the tracks 26, and they prevent the body 94 from becoming misaligned within the track 26.

As seen in FIG. 4 and 5, the sprockets 80 and 84 are connected by the chain 88, and the sprockets 80 and 84 have an outside diameter that is substantially equal in size. The sprocket 84 is connected to another sprocket 116 (shown in phantom) having an outside diameter approximately one half the sprocket 84. The sprockets 84 and 116 are securely connected to the axle 86 such that the sprockets rotate simultaneously to create a 2:1 reduction ratio. The distance between the axle 82, which the sprocket 80 is connected, and the axle 86 is preferably between about 60 and 70 inches, and more preferably about 65 inches apart. An intermediate chain 118 is attached to the sprocket 116 and is connected to a sprocket 120. The sprocket 120 is connected to an axle 121 and the sprocket 120 has an outside diameter substantially equal to the outside diameter of sprockets 80 and 84. The distance between the axle 86 and the axle 121 is preferably about 2 to 6 inches, and more preferably about 4 inches.

The sprocket 120 is securely connected to the axle 121. A dual sprocket 122, which has an outside diameter about half the outside diameter of sprocket 120, is also securely connected to the axle 121 to create another 2:1 reduction ratio. A double chain 124 engages the dual sprocket 122 and is connected to a dual sprocket 126 located proximate the base 12 of the exercise machine 10. The double chain 124 is used because of its increased strength. The dual sprocket 126 rotates about an axle 128 and the distance between the axle 128 and the axle 121 is preferably between about 20 and 30 inches, and more preferably about 24 inches. When the chains are moved, the two 2:1 reduction ratios of the sprockets causes the upper chain 88 to move approximately four times the distance as the double chain 124.

Other known means may also be used to connect the trucks and sprockets, such as inelastic cables, ropes or cog belts. Chains, however, are preferred because they wear longer, prevent slack and preclude undesirable slippage between the connection of the trucks and the sprockets. Additionally, a type 35 chain is advantageously used to reduce cogging of the machine 10 while still providing sufficient strength. Further, the type 35 chain is used for smoother operation and longer life of the exercise machine 10.

Attached to the dual chain 124 are foot trucks 130 and 132 which support the pedals 44 and 46, respectively. The foot trucks 130 and 132 are generally identical in form and function as the hand trucks 90 and 92 described above, except the foot trucks contain only a single sliding block 114 attached to the left wall 96 and right wall 98 of the truck, respectively, and the foot trucks have only a single aperture configured to receive the pedal arm 52. The inner surface of the aperture in the foot trucks 130 and 132 is preferably threaded to receive and securely engage the mating threads on the outer surface of the pedal arm 52 of the pedal 46 to support the user during exercise. Alternatively, the pedals 44 and 46 may be bolted to the foot trucks 130 and 132 respectively.

As seen in FIG. 4, the left handle 48 and the left pedal 44 are in an uppermost position while the right handle 50 and the right pedal 46 are in a lowermost position. As seen in FIG. 5, the left handle 48 and the left pedal 44 are in a lowermost position while the right handle 50 and the right pedal 46 are in the uppermost position. The distance between the uppermost position and the lowermost position defines a range of motion. As seen in the accompanying figures, the range of motion of the handles is approximately four times the range of motion of the pedals because of the two 2:1 reduction ratios. That is, for each inch that one of the pedals moves, the corresponding handle moves four inches.

In one preferred embodiment of the invention, the handles and pedals preferably move in coordinated and synchronized movement such that when the handle and pedal on one side of the machine move in one direction, the handle and pedal on the opposite side of the machine move in the opposite direction. Thus, while the handle and pedal are moving upwardly on one side of the machine, the handle and pedal are moving downwardly on the other side of the machine. Additionally, both handles 48 and 50 are moving at the same velocity because they are interconnected by the chain 88, and both pedals 44 and 46 are moving at the same velocity because they are interconnected by the chain 124.

The distance between the pedal 44 and the center of the hand truck 90 on the left side of the machine 10 is preferably about 58 inches when the hand and foot trucks 90 and 130 are located in the center of each respective range of motion. The distance between the pedal 46 and the center of the hand truck 92 on the right side of the machine 10 is also about 58 inches when the hand and foot trucks 92 and 132 are located in the center of each respective range of motion because the handles 48 and 50 and the pedals 44 and 46 move in a synchronized and coordinated movement. As discussed above, the distance between the handles 48 and 50 and pedals 44 and 46, respectively, can readily be adjusted for users of different heights because the handles 48 and 50 are adjustably connected to the hand trucks 90 and 92.

The maximum range of motion of the handles 48 and 50 between the uppermost and lowermost positions is preferably at least 20 inches and more preferably 40 inches. The maximum range of motion of the pedals 44 and 46 is preferably at least 5 inches and more preferably 10 inches. The range of motion of the handles is preferably synchronized to the pedals such that the range of motion of the handles 48 and 50 is preferably four times the range of motion of the pedals 44 and 46. Most preferably, the maximum range of motion of the handles 48 and 50 is 40 inches and the maximum range of motion of the pedals 44 and 46 is 10 inches.

Figure 9:
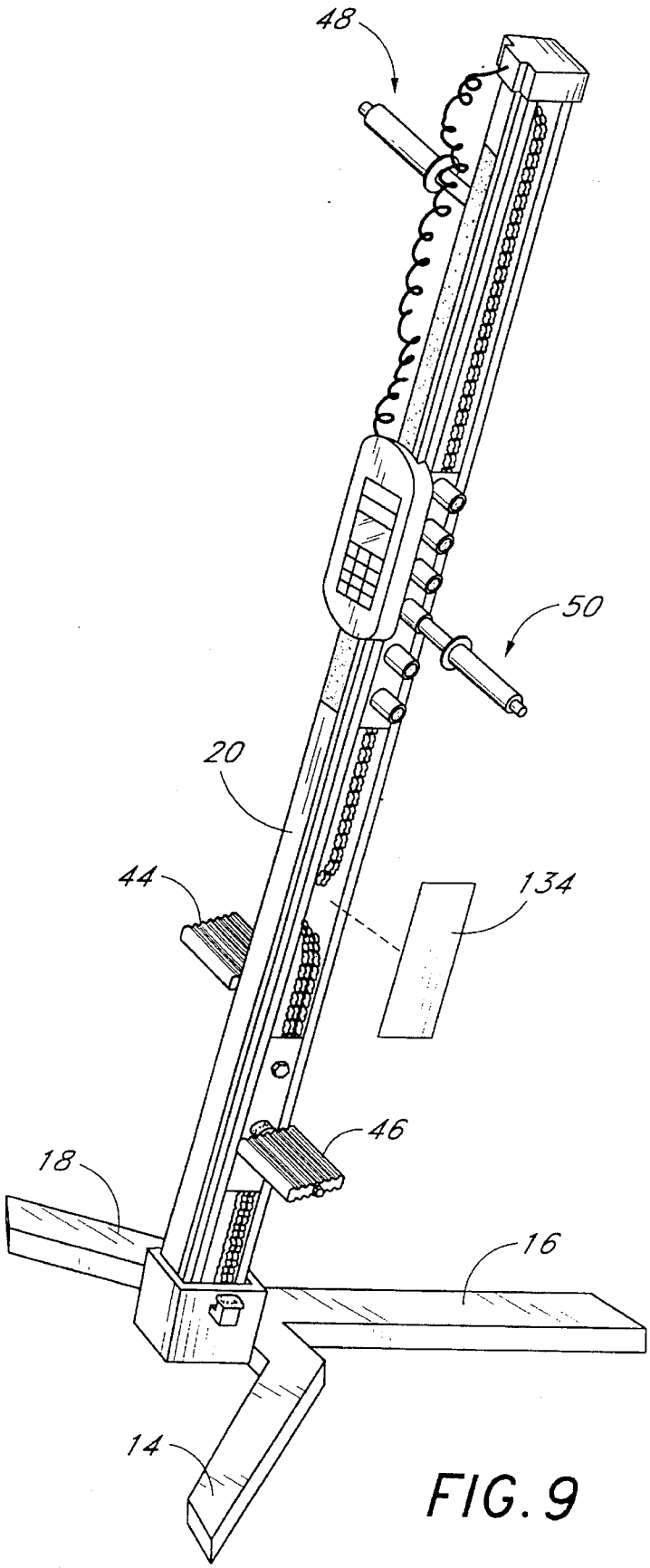
FIG. 9 is a perspective side view of the climbing exercise machine of FIG. 1 showing the cover.

A cover 134, as seen in FIG. 9, may be attached to the sides of the upright frame 20, between the lowermost hand position and the uppermost pedal position to improve the appearance of the exercise machine 10. The cover 134 also protects the user from the moving parts. Preferably, the cover 134 is constructed from vacuum formed plastic, but a wide range of materials may be used to construct the cover 134. The cover 134 is preferably about 16 inches in length such that it does not interfere with the movement of either the handles or the pedals.

Figure 7:
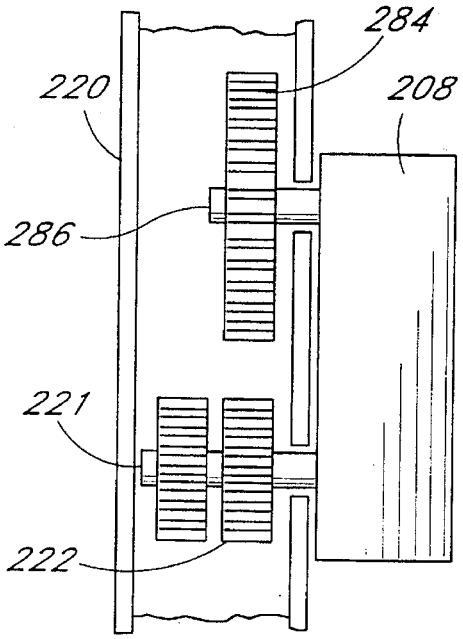
FIG. 7 is a partial cross sectional view along line 7—7 of FIG. 6.
Figure 6:
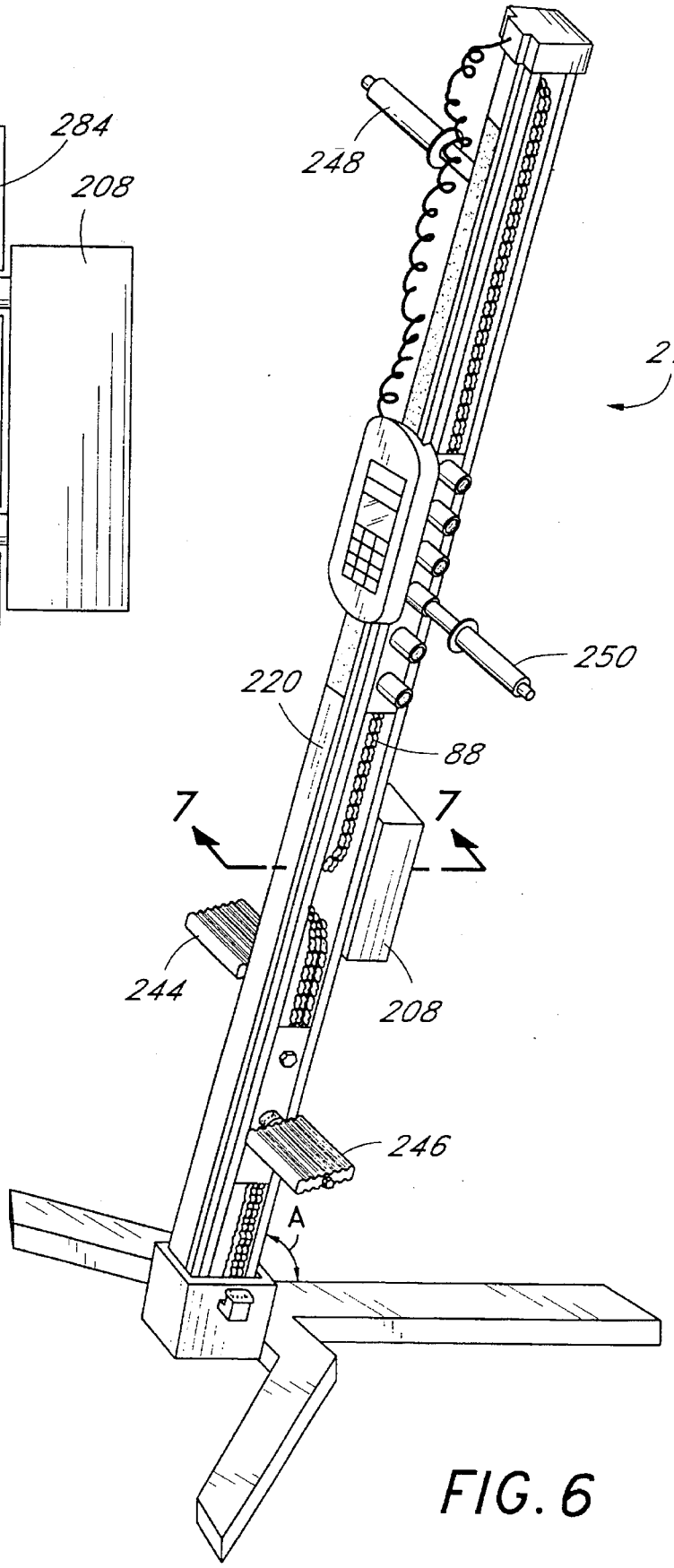
FIG. 6 is a perspective side view of a climbing exercise machine in accordance with another preferred embodiment of the present invention.

An alternative embodiment of the present invention is shown in FIGS. 6 and 7. The exercise machine 210 is configured generally the same as the exercise machine 10 in FIG. 1, except a variable gear ratio transmission 208 is attached to the upright 220. The transmission 208 allows the sprockets or gears contained within the upright frame 220 to be interconnected to provide a different and adjustable range of motion between the handles 248 and 250, and the pedals 244 and 246. The transmission 208 may be any of a large number of well known variable transmissions and it connects the axles 286 and 221. The transmission 208 eliminates the need for the chain 118 to interconnect the sprocket 284 and the dual sprocket 222, and it maintains the synchronized movement of the handles and pedals. The transmission 208 may also reverse the movement of the handles 248 and 250 relative to the pedals 244 and 246 to create a cross crawl pattern of climbing, as described below.

Figure 10:
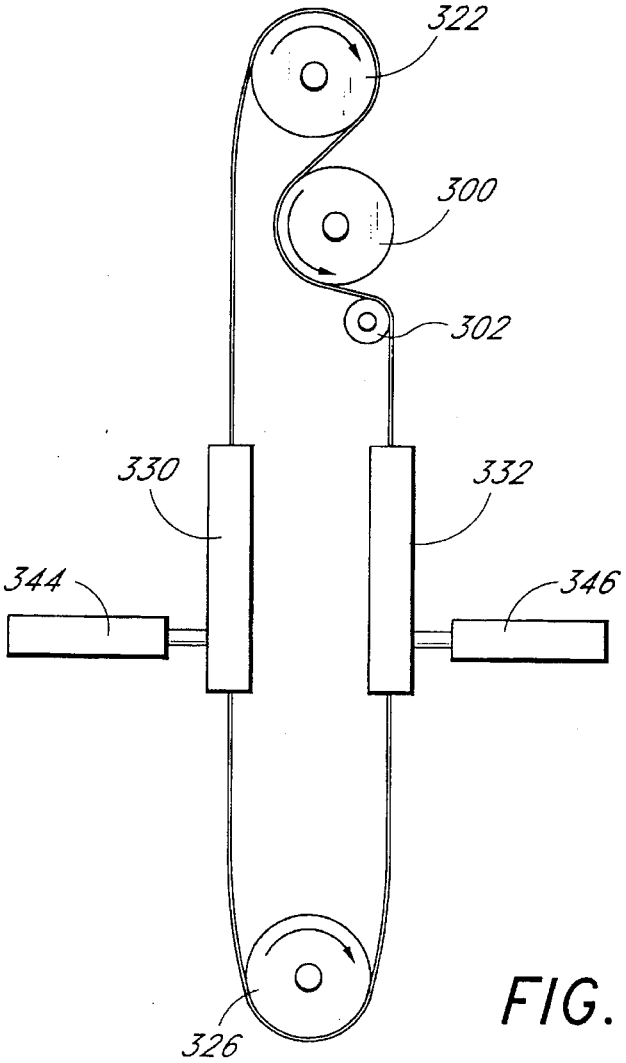
FIG. 10 is a schematic side view of a climbing exercise machine in accordance with another preferred embodiment of the present invention.

Further, another embodiment of the present invention is contemplated to include a cross crawl pattern of climbing. In the cross crawl pattern of climbing, the right arm and right leg extend away from one another as the left arm and left leg move towards one another, and vice versa. As seen in FIG. 10, a reversing sprocket 300 and an idler sprocket 302 may be added to create a cross crawl pattern of climbing. The reversing sprocket 300 rotates in the opposite direction as the sprocket 322. The reversing sprocket 300 is connected to the chain 118 which is attached to the handles such that the left handle 48 moves toward the left pedal 44 while the right handle 50 moves away from the right pedal 46, and vice versa.

The operation of the embodiment of the exercise machine 10, showing the homolateral climbing movement in FIGS. 1 through 9, will now be discussed. The user mounts the pedals 44 and 46, and grasps the handles 48 and 50 as illustrated in FIG. 2. The user may adjust the hand position by moving the handles 48 and 50 to the appropriate aperture 106, preferably such that the handles are about or slightly above shoulder height. The user may also input information to the controller 62 through the keys 66 to select the desired exercise program or create his or her own exercise program. For instance, the user can select the desired amount of calories consumed per minute, rate of climb or duration of exercise.

The user begins exercising by pressing down on one foot pedal and pulling down on a handle on the same side of his or her body until the leg is substantially straight and the arm is bent at about a ninety degree angle. Then the user presses down with the other leg and pulls down on the other handle. When the exercise machine 10 is used over several cycles, a coordinated and synchronized climbing motion is developed.

As seen in FIGS. 4 and 5, the range of motion of the handles 48 and 50 is preferably greater than the range of motion of the pedals 44 and 46. For instance, the preferred range of motion of the arms is about 40 inches and the preferred range of motion of the legs is about 10 inches. The range of motion of the handles is preferably about 40 inches such that the user subjectively perceives a thorough upper body workout in comparison to prior exercise machines which have a range of motion of 20 inches. The range of motion of the legs is preferably about 10 inches such that the user subjectively perceives a less strenuous lower body workout than prior exercise machines having a range of motion of 20 inches.

Preferably, the range of arm motion to the range of leg motion in an embodiment of the invention is about 4:1 such that the typical exerciser subjectively perceives a less strenuous full body exercise than prior exercise devices which required a range of motion of the arms and legs of 20 inches.

The 4:1 ratio of arm motion to leg motion is also preferred because it induces a more natural and rhythmic motion of the human body. The large range of motion of the handles increases the desired upper body cardiovascular exercise of the user relative to that obtained through movement of the handles in a 1:1 ratio machine. The range of motion of only 10 inches of the pedals, instead of the 20 inches usually found in the 1:1 ratio machine, decreases the amount of lower body exercise of the user and allows persons with a wider range of physical and athletic abilities to use the exercise machine 10 because it requires less effort to move the pedals in a range of motion of only 10 inches. By reducing the stroke through which the pedals are moved and increasing the stroke through which the handles are moved, a workout which is perceived as less strenuous, is provided while maintaining the benefits of a coordinated full body climber exercise motion. This permits a wider range of users to enjoy a full body climber workout.

Advantageously, the ratio of the range of motion of the arms to the legs can also be varied. This allows the user to select the desired amount of upper body exercise relative to the lower body exercise. This allows a wide range of users to exercise at user selected levels of exercise effort.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A climbing exercise machine, comprising:

a base;

an upright member having a right track and left track, said upright member being connected to said base;

a first truck and a second truck mounted in said right track, said first truck having a handle and said second truck having a pedal, said first truck moving within a first range of motion and said second truck moving within a second range of motion;

a third truck and a fourth truck mounted in said left track, said third truck having a handle and said fourth truck having a pedal, said third truck moving within a third range of motion and said forth truck moving within a fourth range of motion;

a first connection between said first truck and said second truck such that said first range of motion is greater than said second range of motion; and a second connection between said third truck and said fourth truck such that said third range of motion is greater than said forth range of motion.

2. A climbing exercise machine as in claim 1, wherein said first truck, said second truck, said third truck and said forth truck move in substantially a single plane.

3. A climbing exercise machine as in claim 1 additionally comprising an interconnection between said first truck and said third truck.

4. A climbing exercise machine as in claim 3, wherein said first range of motion is substantially equal to said third range of motion.

5. A climbing exercise machine as in claim 3, wherein said second range of motion is substantially equal to said forth range of motion.

6. A climbing exercise machine as in claim 3, wherein said first range of motion is approximately four times greater than said second range of motion, and said third range of motion is approximately four times greater than said forth range of motion.

7. A climbing exercise machine as in claim 1, wherein said handles and said pedals move in a homolateral movement.

8. A climbing exercise machine as in claim 1, wherein said handles and said pedals move in a cross crawl movement.

9. A climbing exercise machine to provide simulation of a vertical climbing motion by enabling coordinated leg and arm movement, said climbing exercise machine comprising:

a base;

a right track and a left track, said right track and said left track arranged substantially parallel to one another in side by side relationship, said right and left tracks attached to said base member such that one end of each of said tracks is at a higher elevation that the other end;

a first truck and a second truck, said first truck and said second truck mounted on said right track for movement along said right track with said first truck mounted above said second truck;

a third truck and a forth truck, said third truck and said forth truck mounted on said left track for movement along said left track with said third truck mounted above said forth truck;

a first handle extending from said first truck, a second handle extending from said third truck, a first foot support extending from said second truck, and a second foot support extending from said forth truck, each of said first and second handles and said first and second foot supports mounted such that their movement is within a single plane;

each track having at least one bearing surface which supports said trucks, said bearing surface substantially parallel and opposed to each other, said surface bearing at least a portion of the load applied by the user to the exercise machine, said handles and said foot supports extending outwardly from their respective tracks in a direction generally opposite to the bearing surface in their respective tracks;

a first connection between said first truck and said second truck wherein a movement of said first truck is greater than a corresponding movement said second truck; and a second connection between said third truck and said forth truck wherein a movement of said third truck is greater than a corresponding movement of said forth truck.

10. A climbing exercise machine as in claim 9, wherein the movement of said first truck is about four times greater than the movement of said second truck.

11. A climbing exercise machine as in claim 9, wherein the movement of said third truck is about four times greater than the movement of said forth truck.

12. A climbing exercise machine as in claim 9, wherein said first truck is coordinated to a movement of said third truck, said second truck is coordinated to a movement of said forth truck.

13. A climbing exercise machine as in claim 9, wherein said first handle moves from an uppermost position to a lowermost position to create a first range of motion, said second handle moves from an uppermost position to a lowermost position to create a second range of motion, said first foot support moves from an uppermost position to a lowermost position to create a third range of motion, said second foot support moves from an uppermost position to a lowermost position to create a forth range of motion, said first range of motion is approximately equal said second range of motion and said third range of motion is approximately equal to said forth range of motion.

14. A climbing exercise machine as in claim 13, wherein said first range of motion is approximately four times greater than said third range of motion.

15. A climbing exercise machine as in claim 9, wherein said first handle, said second handle, said first foot support and said second foot support move in a homolateral movement.

16. A climbing exercise machine as in claim 9, wherein said first handle, said second handle, said first foot support and said second foot support move in a cross crawl movement.

17. A synchronized exercise machine, comprising:

a base;

an upright member having a left side and right side, said upright member being connected to said base;

a left handle and a right handle, and a right pedal and a left pedal, said left handle and said left pedal move in synchronized movement on said left side of said upright member, said right handle and said right pedal move in synchronized movement on said right side of said upright member, said left handle moves the same distance as said right handle, said left pedal moves the same distance as said right pedal, wherein said distance moved by the handles is different than said distance moved by the pedals.

18. An exerciser as in claim 17, wherein said left and right handles move within a first range of movement and said left and right pedals move within a second range of movement.

19. An exerciser as in claim 18, wherein said first range of movement is greater than said second range of movement.

20. An exerciser as in claim 18, wherein said first range of movement is approximately four times greater than said second range of movement.

21. An exerciser as in claim 17, wherein said distance moved by the pedals results in a larger distance moved by the handles.

22. A method of exercising arms and legs of the user, said method comprising:

providing an exercise machine, said exercise machine comprising a climber having a first pedal and a second pedal, and a first handle and a second handle, said handles and pedal moving in a single plane;

positioning the feet on the pedals;

gripping the handles with the hands; and moving said first handle and said first foot upwards while simultaneously moving said second handle and said second foot pedal downwardly, said handles moving some fixed percentage more than said foot pedals.

23. An exercise machine comprising:

two handles and two foot pedals;

two oppositely disposed elongated handle guides and two oppositely disposed elongated foot pedal guides, each said handle mounted to move along one of handle guides and each said foot pedal mounted to move along one of said foot pedal guides, said handles and said foot pedals interconnected with one another such that all pedals and handles move synchronously and movement of the foot pedals along the foot pedal guides through a given distance results in a movement of the handles along the handle guides through a greater distance.

* * * * *

UNITED STATES PATENT AND TRADEMARK OFFICE

CERTIFICATE OF CORRECTION

PATENT NO. : 5,492,515

DATED : February 20, 1996

INVENTOR(S) : Richard D. Charnitski

It is certified that error appears in the above-indentified patent and that said Letters Patent is hereby corrected as shown below:

Column 11, Claim 9, Line 13, please delete "that" and add --than--;

Column 11, Claim 9, Line 39, please add --of-- in between the words "movement" and "said";

Column 11, Claim 13, Line 63, please add --to-- in between the words "equal" and "said"; and Column 12, Claim 22, Line 44, please delete "pedal" and add --pedals--.

Signed and Sealed this

Second Day of July, 1996

Bruce Lehman

*Attest:*

BRUCE LEHMAN

*Attesting Officer*

*Commissioner of Patents and Trademarks*